United States Patent [19]

Gendron

[11] 3,999,746

[45] Dec. 28, 1976

[54] METHOD OF MAKING A COMBINED BROCHURE AND RETURN ENVELOPE PACKAGE

[75] Inventor: Wilfred Gendron, Wilbraham, Mass.

[73] Assignee: United States Envelope Company, Springfield, Mass.

[22] Filed: May 21, 1975

[21] Appl. No.: 579,737

Related U.S. Application Data

[62] Division of Ser. No. 347,412, April 3, 1973, Pat. No. 3,941,309.

[52] U.S. Cl. ..... 270/37

[51] Int. Cl.[2] ..... B41L 43/12

[58] Field of Search ..... 93/63 M, 63 R, 61 R; 270/37–38, 41, 5; 229/69, 68 R; 156/200–204, 226, 227, 438, 443, 474, 519, 563

[56] References Cited

UNITED STATES PATENTS

| | | | |
|---|---|---|---|
| 3,557,519 | 1/1971 | Lyon | 93/63 M |
| 3,665,817 | 5/1972 | Katz | 270/37 |
| 3,743,273 | 7/1973 | Katz | 270/37 |
| 3,899,381 | 8/1975 | O'Brien | 270/37 |

*Primary Examiner*—Edgar S. Burr
*Assistant Examiner*—A. Heinz
*Attorney, Agent, or Firm*—Richard L. Schmalz; Vernon F. Venne

[57] ABSTRACT

A method is disclosed for making a paper product intended for use as an advertising piece or the like and consisting of a multiple paged brochure, a return mailing envelope and a return application or order form combined in a single package adapted in one form for non-mailing uses, such as a newspaper drop-in or handout, and in another form as a mailing package. The method may be performed on a web feed machine for making a large number of packages from a single substantially continuous web of material. It consists essentially of a number of foldings of a web along longitudinal fold lines, a number of perforations of the web along longitudinal lines, and a number of applications of adhesive to the web, followed by transverse severing of the folded, perforated and adhesively sealed web to separate individual packages from the web, all of which operations may be performed as the web moves continuously through a forming machine.

5 Claims, 15 Drawing Figures

METHOD OF MAKING A COMBINED BROCHURE AND RETURN ENVELOPE PACKAGE

CROSS REFERENCE TO RELATED APPLICATION

This application is a division of application Ser. No. 347,412, filed Apr. 3, 1973, now U.S. Pat. No. 3,941,309 which issued Mar. 2, 1976, and entitled COMBINED BROCHURE AND RETURN ENVELOPE PACKAGE.

BACKGROUND OF THE INVENTION

This invention relates to methods for making products from paper or similar sheet material, and deals more specifically with such a method for making a multipaged brochure, a return mailer, and an order form or other detachable page all combined into a single package adapted for use as an advertising piece or the like.

The paper package made by the method of this invention may be put to various different uses, but is particularly well adapted for use in connection with mail order advertising. In such advertising, it is desirable to supply a potential customer with information concerning the products or services offered for sale, an application or order form to be completed by the customer, and an envelope to be used by the customer in returning the application or order form to the advertiser.

The object of this invention is to provide an improved method for making a package of the aforementioned kind. In particular, an object of the invention is to provide such a method which involves a number of simple folding, perforating, adhesive applying and severing steps which are readily carried out by a forming machine on a substantially continuous web of sheet material as the web is moved continuously through the machine.

SUMMARY OF THE INVENTION

The invention resides in the method for making a specific form of combined brochure and return envelope package, which method involves the steps of continuously advancing a web of paper or similar sheet material through a number of stations at which it is folded and perforated along longitudinally extending lines, at which glue is applied to selected areas of the web, and at which the folded, perforated and glued web is subsequently severed along transverse lines to separate individual completed packages from the web.

DETAILED DESCRIPTION OF THE PREFERRED EMBODIMENTS

Embodiment of FIGS. 1 to 4

Figure 1:
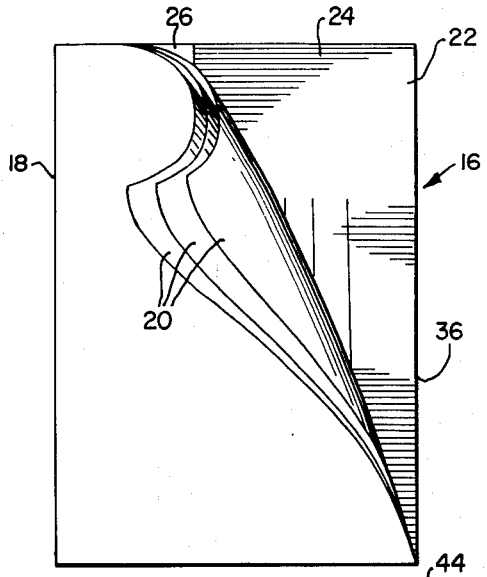
FIG. 1 is a front view of a combined brochure and return envelope package which may be made by the method of this invention, the sheets of the brochure being shown partially turned to reveal a part of the return envelope.
Figure 2:
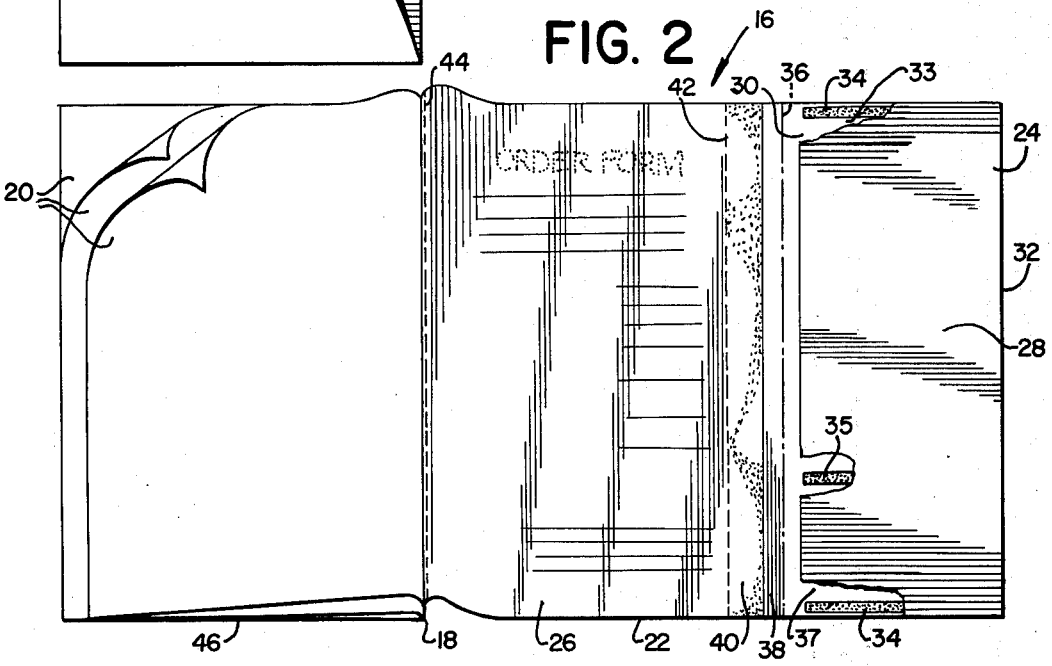
FIG. 2 is a view showing the combined brochure and return envelope package of FIG. 1 in an open condition and with part of the return envelope being shown broken away to better reveal its structure.
Figure 3:
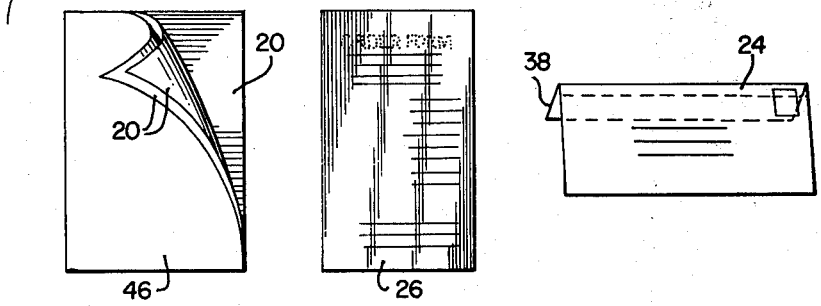
FIG. 3 is a view showing the brochure, return envelope, and order form of the package of FIG. 1 separated fron one another.

First considering FIGS. 1, 2 and 3, these figures show a combined brochure and return envelope package 16 made of paper or similar sheet material. The package 16, as shown in FIG. 1, contains a number of leaves which are secured to one another along the package's left-hand edge 18. Three of the leaves, indicated at 20, 20 are of single thickness and define pages of a brochure on which advertising copy of the like may be printed. The leaf 22, when the package is in the substantially unopened condition of FIG. 1, is comprised of a number of layers of material folded upon themselves and so perforated and adhered to one another as to provide both a return envelope 24 and an additional page portion 26 which may be used to receive additional advertising copy or the like or which may be used to serve as an order form or the like to be returned in the return envelope.

FIG. 2 shows the package 16 opened to the envelope leaf 22 and the leaf 22 unfolded to better reveal the return envelope 24 and the associated leaf portion 26. Although the leaf portion 26 may be used for other purposes, it is preferably used as an order form and is hereinafter referred to as such.

The return envelope 24, as best shown in FIG. 2, consists of a rear panel 28 overlying a front panel 30. At the bottom edge of the envelope the two panels 28 and 30 are attached to one another along a fold line 32 and at the two ends of the envelope the panels 28 and 30 are secured to one another by lines of adhesive 34, 34. An additional line of adhesive 35 is used to divide the envelope pocket into a main pocket 33 and a smaller pocket 37 which may be used to receive one or more coins, coupons or tokens in the return mailing. Connected to the front panel 30 along a fold line 36 is a sealing flap 38 containing a line of remoistenable adhesive 40. When the package 16 is in the closed or unopened condition of FIG. 1, the return envelope 24 is folded along the fold line 36 into overlying relationship with the order form 26.

The return envelope 24 is attached to the order form 26 along a perforated line 42 which allows the envelope to be readily detached from the order form by tearing along the line 42. After the envelope is so removed, it may, of course, be sealed for mailing by moistening the adhesive 40 and folding the seal flap 38 into overlying relationship with the rear panel 28.

The order form 26 is connected to the remainder of the package 16 along another line of perforation 44. Therefore, by tearing along the line of perforation 42 and the line of perforation 44, the package 16 may be separated into three separate items, namely the return envelope 24, the order form 26 and a brochure 46 made up of the three pages 20, 20. These three items are separated from one another are shown in FIG. 3.

Figure 4:
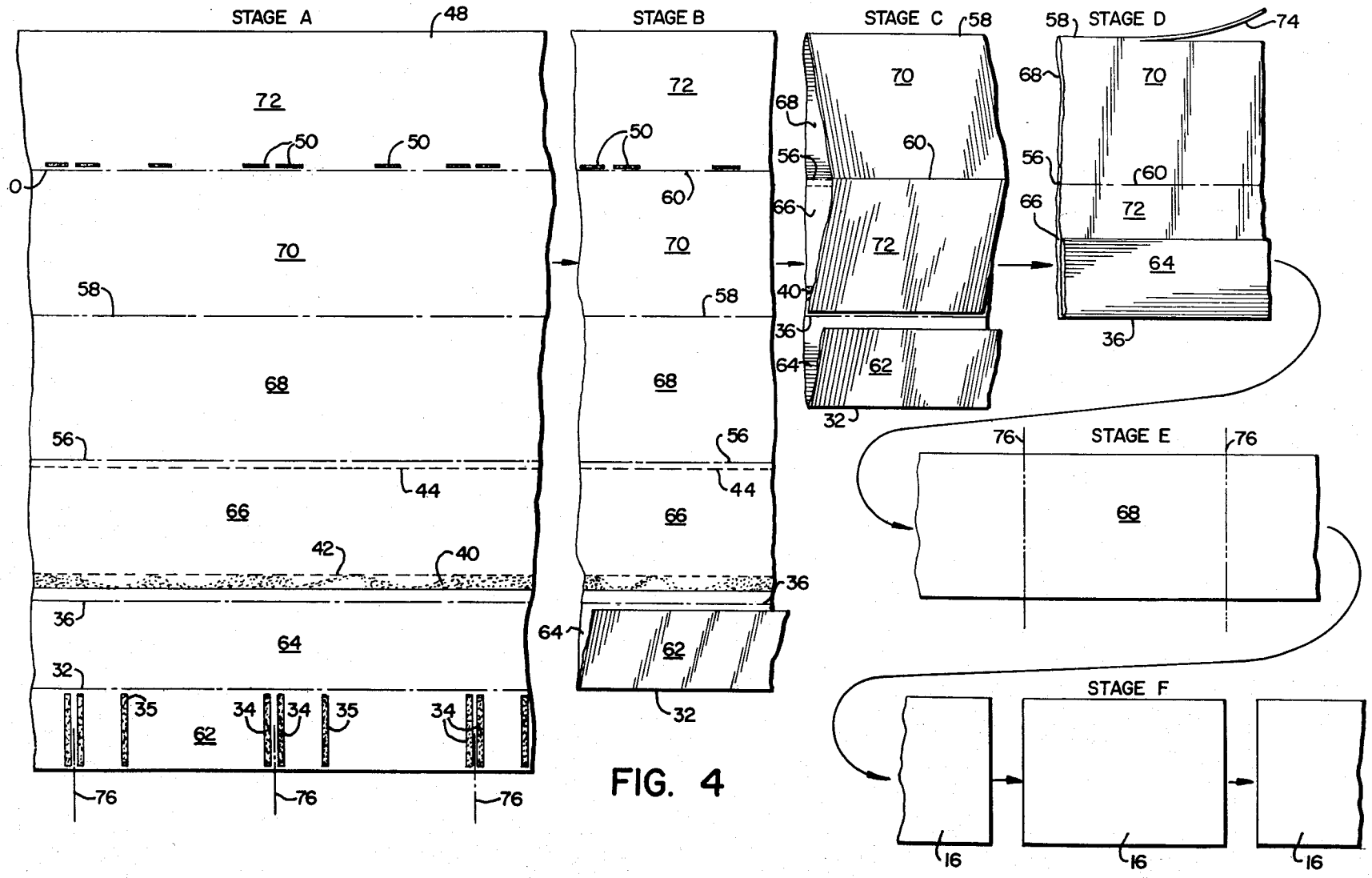
FIG. 4 is a view showing the successive stages in a method comprising one embodiment of this invention for manufacturing packages such as shown in FIG. 1 from a single web of sheet material.

One of the advantages of the above-described package 16 is that it may readily be made through the use of a web fed forming machine wherein a web of paper or the like from which the package is made is moved continuously through the machine. FIG. 4 shows the various steps involved in a method of making packages such as the package 16 of FIGS. 1 to 3, the various steps of which method, it will be understood, may readily be performed at different stations in a web fed machine. Referring to FIG. 4, the illustrated method progresses from the left of the figure toward the right, in the sequence indicated by the dashed lines and arrows, and the illustrated stages of the method are identified as Stage A, Stage B, etc.

In FIG. 4 the web of sheet material from which the packages are made is indicated at 48. Prior to reaching the illustrated Stage A, the web 48 is perforated along the longitudinally extending lines 42 and 44, remoistenable adhesive is applied and dried along the line 40, and moist adhesive is applied along the illustrated lines 34, 34, 35, 35 and 50, 50. The broken lines 32, 36, 56, 58 and 60 are fold lines along which the web 48 is subsequently folded. These fold lines divide the web 48 transversely into a number of longitudinally extending strips 62, 64, 66, 68, 70 and 72. It will, of course, be understood that prior to reaching Stage A, the various steps involved in perforating the web along the lines 42 and 44 and in applying adhesive to the web may be performed in any desired and convenient sequence. Also, if desired, some of these steps, such as the application of the glue to the lines 50, 50 or the perforation of the lines 42 and 44, may be performed subsequently to the illustrated Stage A, it being understood that FIG. 4 shows only one of several specific sequences by which the various steps of the method may be performed.

Following the illustrated Stage A of FIG. 4, the web 48 is folded along the fold line 32 to bring the strip 62 into overlying relationship with the strip 64, as shown at Stage B, and in doing this the two strips 62 and 64 are secured to one another by the lines of adhesive 34, 34 and 35, 35. Next, as shown at Stage C, the web is folded along the fold line 58 to bring the strips 70 and 72 into overlying relationship with the strips 68 and 66, respectively. The lines of glue 50, 50 on the strip 72 are so located that as the strip 72 is flattened against the strip 66 the glue lines 50, 50 engage the strip 66 within the space between the fold line 56 and the perforated line 44, thereby securing the four strips 66, 68, 70 and 72 to one another adjacent the now superimposed fold lines 60 and 56.

Subsequent to Stage C, the two folded and joined strips 62 and 64 are folded along the fold line 36 to bring them into overlying relationship with the strip 72, as shown at Stage D. Also, at Stage D the strips 68 and 70 are separated from one another adjacent the fold line 58, as indicated at 74, by cutting away a small marginal portion of both of said strips along a line of cut located parallel and close to the line 58.

Following Stage D, the two strips 68 and 70 are folded along the superimposed fold lines 56 and 60, as the final folding stage of the method, to define a stack of superimposed strips as shown at Stage E. This stack is then cut along transversely extending lines of cut 76, 76, each of which is located between a respective pair of closely spaced glue lines 34, 34 as shown at Stage A, to separate the stack into individual packages 16, 16 as shown at Stage F.

Embodiment of FIGS. 5 to 9

The package 16 of FIGS. 1 to 4 is one primarily intended for use as a non-mailed item such as a handout or newspaper or magazine drop-in. FIGS. 5 to 9 show a different package 78 adapted for use as a direct mailing piece.

Figure 6:
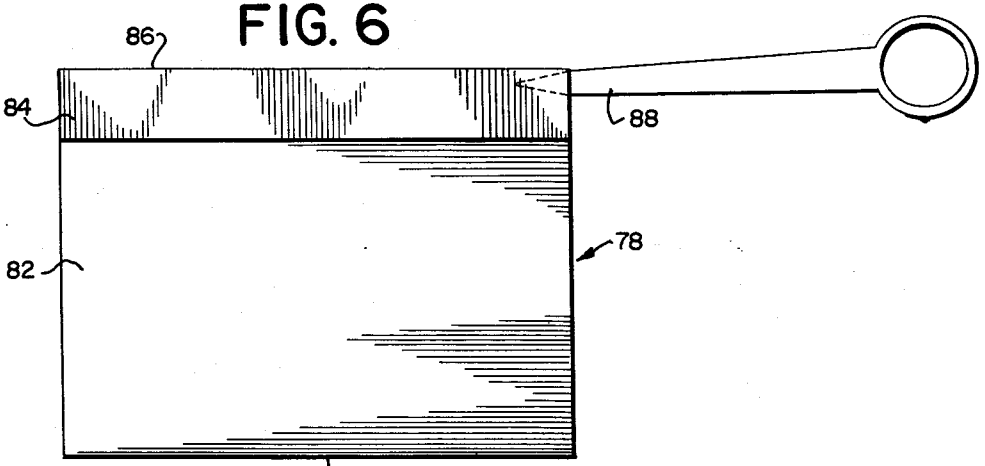
FIG. 6 is a rear view of the package of FIG. 5 and additionally shows the package in the process of being opened by an opening implement.
Figure 5:
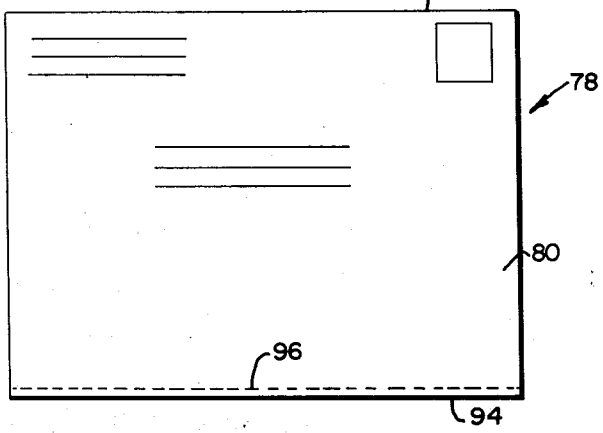
FIG. 5 is a front view of a package which may be made by the method of this invention.

Referring to FIGS. 5 to 8 which show the structure of the package 78, this package includes a plurality of leaves including two end leaves 80 and 82. The end leaf 80 includes an extension 84 which is folded about the fold line 86, forming one edge of the package and preferably weakened by perforations, into overlying relationship with the end leaf 82. The extension 84 is adhesively adhered to the end leaf 82 to initially form the package 78 into a sealed, closed unit suitable for mailing, as shown in FIGS. 5 and 6. The end leaf 80 is taken to be the front panel of the sealed unit and preferably, as shown in FIG. 5, includes space for receiving a mailing address, a return address and a stamp or mailing permit imprint for mailing purposes. As indicated in FIG. 6, the sealed package may be opened by inserting an opening implement 88 between the end leaves 80 and 82 to sever the end leaf 80 from its extension 84 by tearing along the fold line 86.

Figure 8:
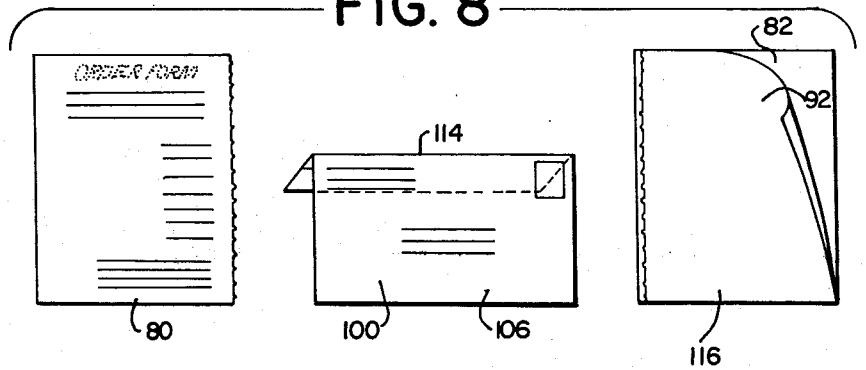
FIG. 8 is a view showing the brochure, return envelope and order form of the package of FIG. 5 separated from one another.
Figure 7:
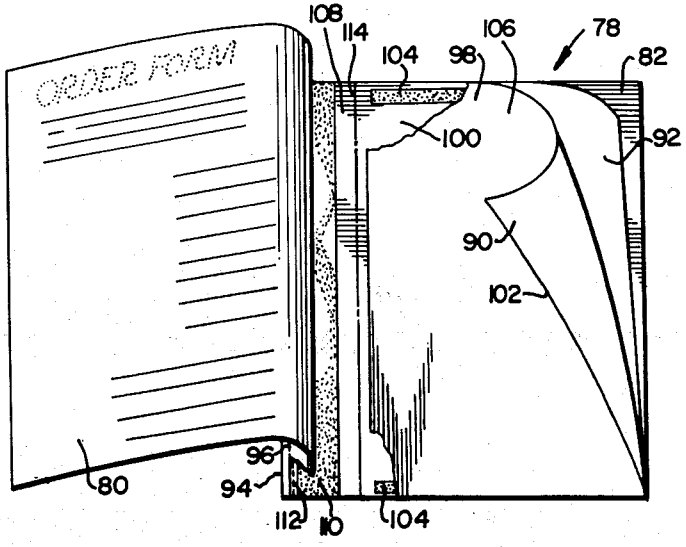
FIG. 7 is a view showing the package of FIG. 5 in an open condition.

FIG. 7 shows the package 78 in an opened condition and from this figure it will be noted that the package, in addition to the end leaves 80 and 82, also includes an envelope leaf 90 and an additional single thickness leaf 92, all of the leaves 80, 82, 90 and 92 being joined to one another along the left-hand edge 94. The end leaf 80 is joined to the remainder of the package 78 by a perforated line 96 located close and parallel to the edge 94. The leaf 80 may, therefore, be readily removed from the remainder of the package by tearing along the line 96 and preferably the inside surface of this leaf is printed to serve as an order form or the like as illustrated in FIGS. 7 and 8. The envelope leaf 90 is comprised of two layers 98 and 100 of material folded upon one another about a fold line 102 and adhered to one another by adhesive lines 104, 104 to form a return envelope 106. As part of the envelope 106 the layer 100 includes a sealing flap 108 containing a line of remoistenable adhesive 110. The sealing flap 108 is connected to the remainder of the package 78 by a perforated line 112, directly underlying the perforated line 96, so that by tearing along the line 112 the envelope 106 may be removed from the package. After the envelope 106 is removed from the package, the adhesive 110 may be moistened and the sealing flap 108 may be folded along the fold line 114 to seal the flap to the layer 98 and to thereby close the return envelope 106 for mailing.

FIG. 8 shows the package 78 separated into its separate components obtained by first opening the package by tearing along the fold line 86, as shown in FIG. 6, and by then tearing along the perforated lines 96 and 112. The resulting components are the order form 80, the return envelope 106 and a brochure 116 comprised of the two leaves 92 and 82.

Figure 9:
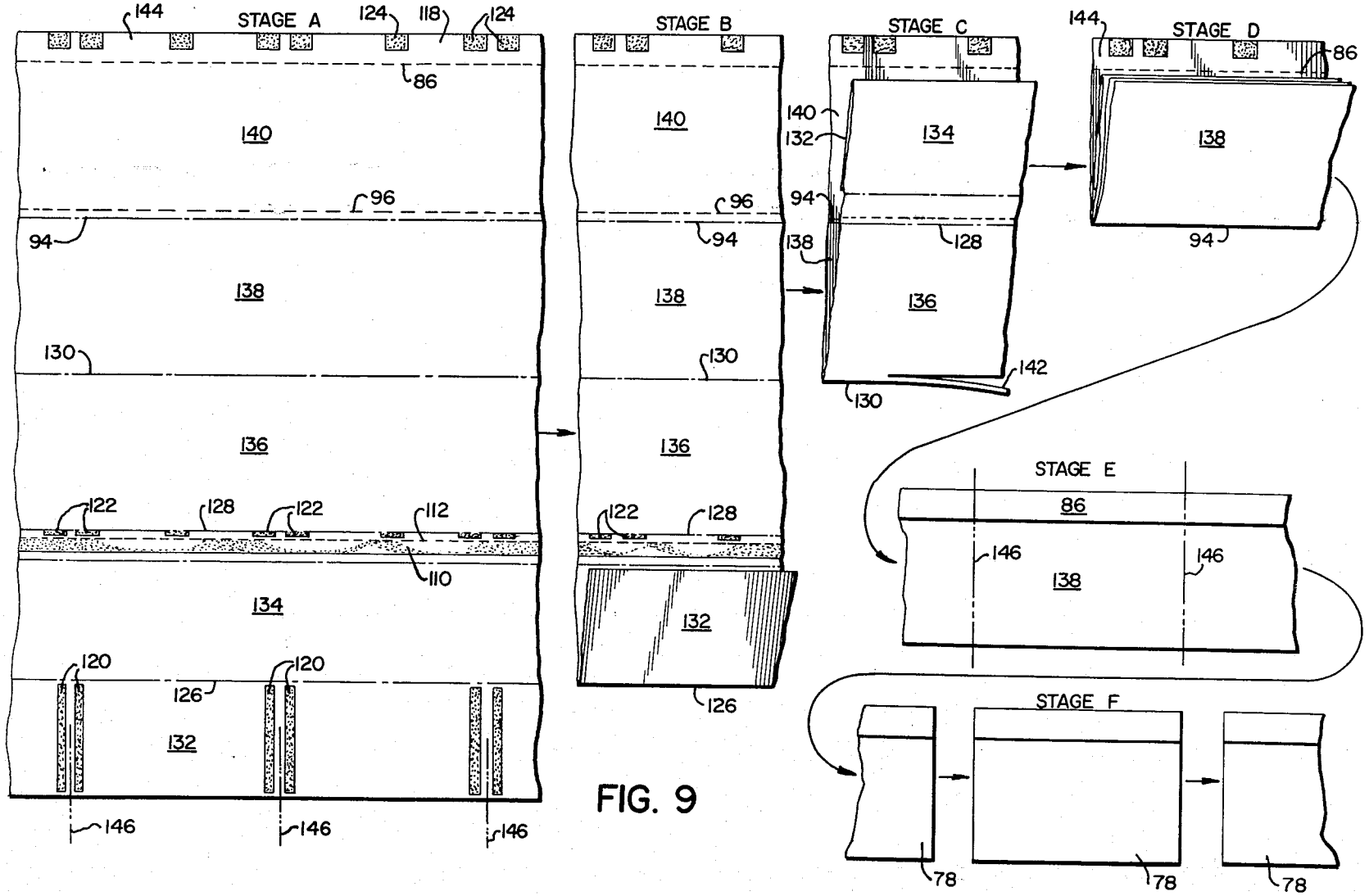
FIG. 9 is a view showing the successive stages in a method comprising another embodiment of this invention for manufacturing packages such as shown in FIG. 5 from a single web of sheet material.
Figure 10:
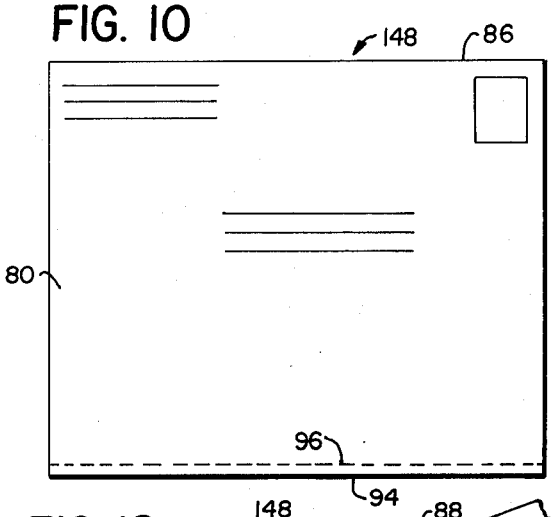
FIG. 10 is a front view of still another package which may be made by the method of this invention.
Figure 11:
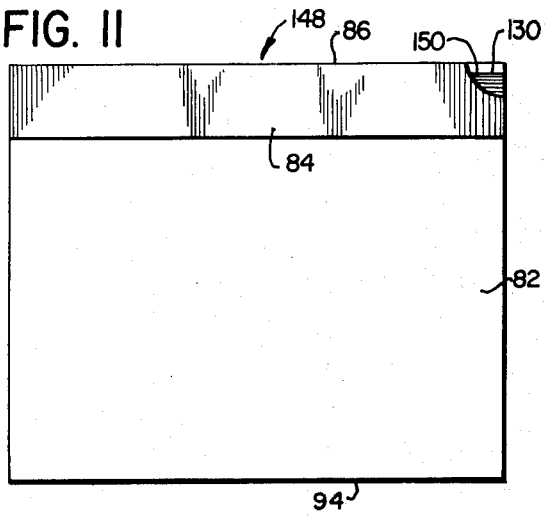
FIG. 11 is a rear view of the package of FIG. 10.

FIG. 9 shows a method by which a continuously moving web of paper or similar sheet material may be formed in various stages to produce packages similar to the package 78 of FIGS. 5 to 8. Referring to FIG. 9, prior to reaching the illustrated Stage A, the web 118 is perforated along three longitudinally extending lines of perforation 86, 96 and 112. It is also provided with a line 110 of remoistenable adhesive and lines or spots of moist adhesive as indicated at 120, 120, 122, 122, and 124, 124. The broken lines 126, 128, 130 and 94 are fold lines along which the web 118 is subsequently folded and they transversely divide the web 118 into a number of longitudinally extending strips 132, 134, 136, 138 and 140.

Progressing from Stage A, the web 118 is first folded along the fold line 126 to bring the strip 132 into overlying relationship with the strip 134, which two strips 132 and 134 are consequently adhered to one another by the adhesive lines 120, 120. Next, as shown at Stage C, the web is folded along the fold line 130 to bring the strip 136 into overlying relationship with the strip 138 and to bring the joined strips 134 and 132 into overlying relationship with the strip 140. At this time, the glue spots 122, 122 which are located on the strip 134 between the perforated line 122 and the fold line 128 engage the strip 140 between the perforated line 96 and the fold line 94 to thereby join together the strips 134, 136, 138 and 140 adjacent the now superimposed fold lines 128 and 94. Also, as shown at Stage C, after folding about the fold line 130 the two strips 136 and 138 are separated from one another adjacent the fold line 130, as indicated at 142, by severing them along a line of cut located parallel and close to the fold line 130.

Thereafter, as shown at Stage D, the web is folded about the superimposed fold lines 128 and 94, and then the extension 144 of the strip 140 is folded about the perforated line 86 to bring such extension into overlying relationship with the strip 138 to which it is adhered by the glue spots 124, 124, as shown at Stage E.

Finally, as shown in Stage F, the stack of overlying strips represented at Stage E is cut along transverse cut lines 146, 146 to separate the stack into separate sealed packages 78, 78, one cut line 146 being located between each closely adjacent pair of glue lines 120, 120, as shown at Stage A.

Embodiment of FIGS. 10 to 15

Figure 15:
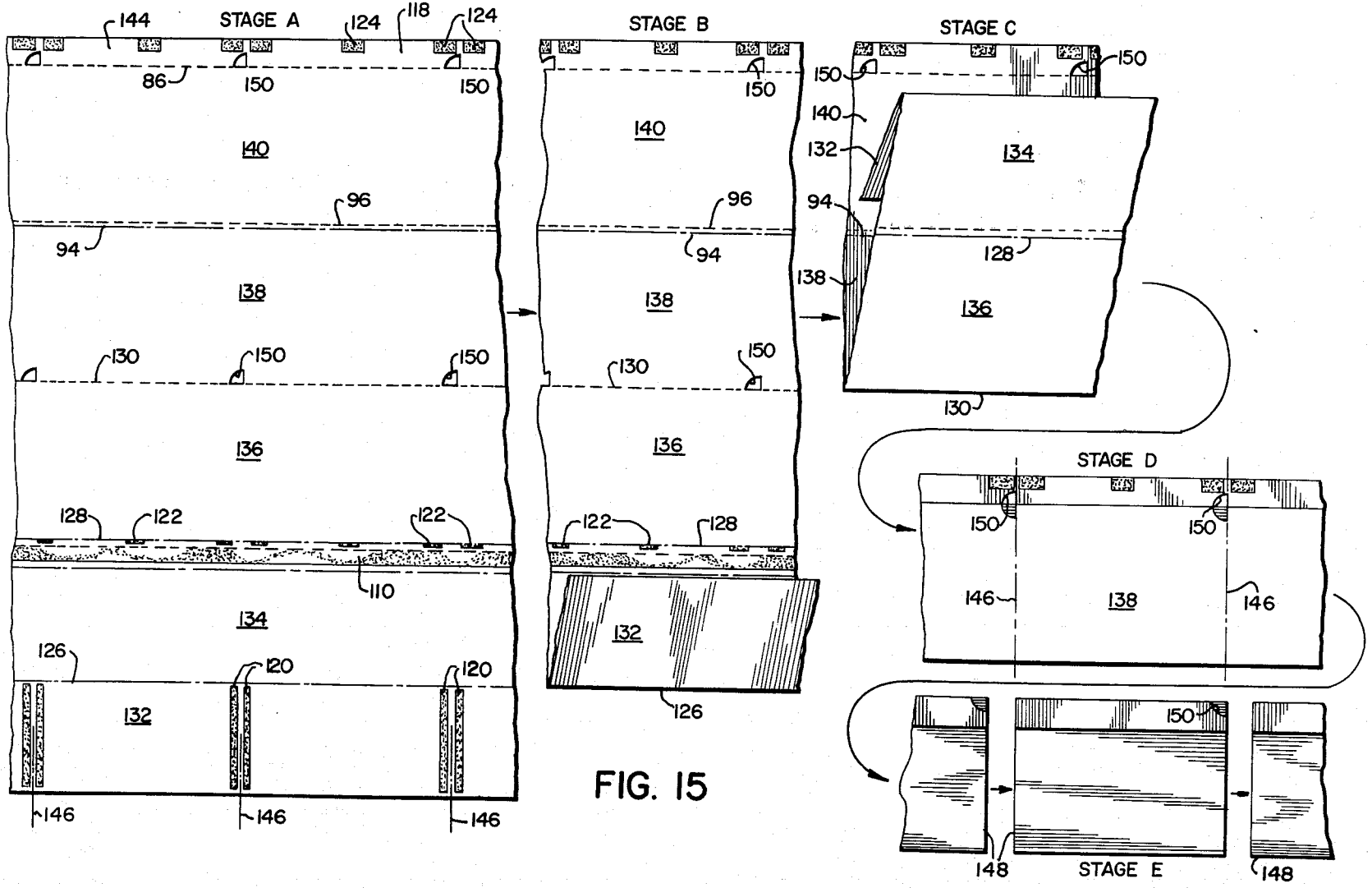
FIG. 15 is a view showing the successive stages in a method comprising another embodiment of this invention for manufacturing packages such as shown in FIG. 10 from a single web of sheet material.

In connection with the package 78 of FIGS. 5 to 9, it should be noted that, due to the cut indicated at 142 in Stage C of FIG. 9, the leaves 82 and 92 are separated from one another along their right-hand edges, as viewed in FIG. 7, even before the package is opened as shown in FIG. 6. This separation of the two leaves 82 and 92 is not entirely necessary, and if desired, the leaves 82 and 92 may be left joined in the sealed package with the package being so designed that as it is opened with an opening implement the two leaves 82 and 92 are separated from one another simultaneously with the package being torn along the perforated line 86. FIGS. 10 to 15 show a package 148 of the latter type of construction. The package 148 is generally similar to the package 78 of FIGS. 5 to 9 and the method by which the package 148 is made may be generally similar to the method by which the package 78 is made. Therefore, in FIGS. 10 to 14 parts of the package 148 which are basically identical to parts of the package 78 have been given the same reference numbers as the corresponding parts of the package 78 and will not be redescribed in detail. Likewise, in FIG. 15, showing the method for making the package 148, features of FIG. 15 which are similar to corresponding features of FIG. 9 have been given the same reference numerals as in FIG. 9 and will not be redescribed in detail.

Figure 12:
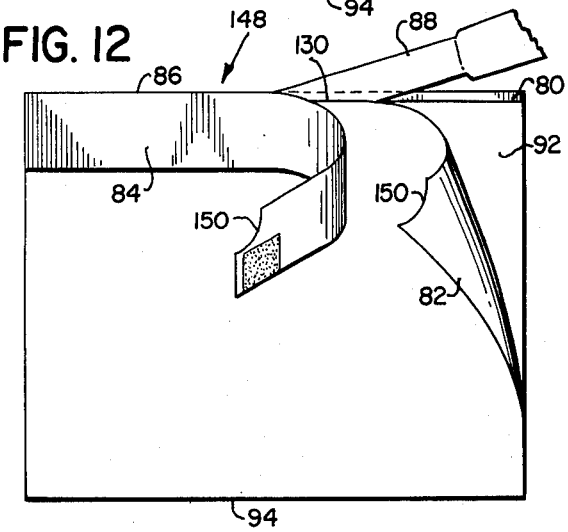
FIG. 12 is similar to FIG. 11 but shows the package partially opened.
Figure 13:
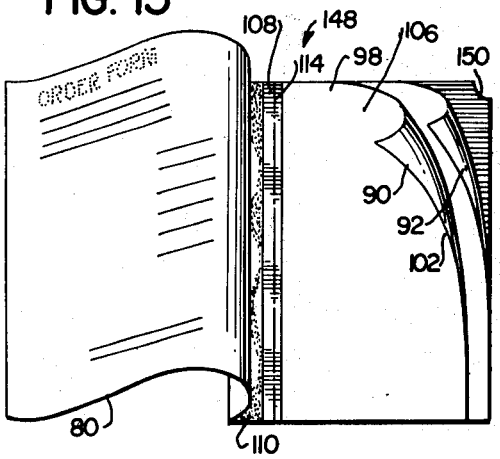
FIG. 13 is a view showing the package of FIG. 10 in an open condition.
Figure 14:
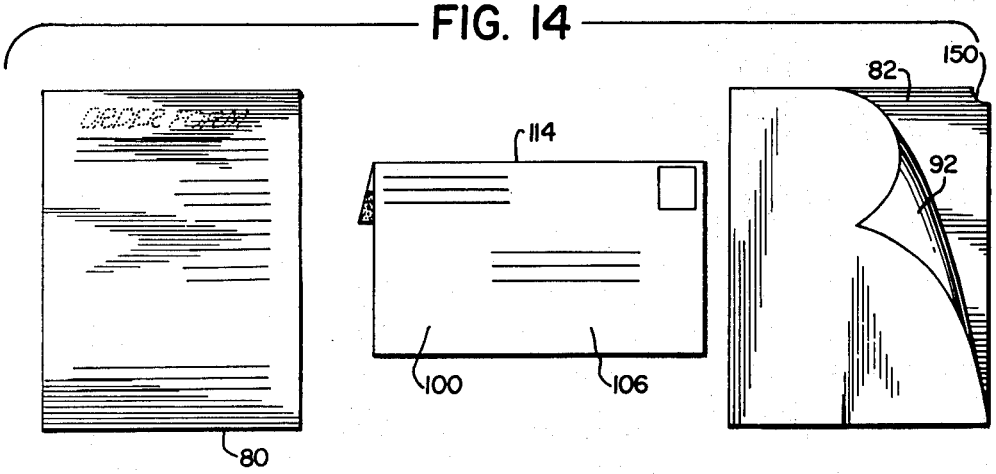
FIG. 14 is a view showing the return envelope, brochure and order form of the FIG. 10 package separated from one another.

Referring first to FIGS. 10 to 14, the package 148 there illustrated is similar to the package 78 except that, as shown best in FIG. 12, in the sealed condition of the package the two leaves 82 and 92 are joined to one another about a fold line 130 located closely adjacent to and parallel with the perforated fold line 86 by which the extension 84 is joined to the leaf 80. Therefore, when the package 148 is to be opened, the opening may be accomplished by using an opening implement 88 placed between the two leaves 82 and 92, as shown in FIG. 12, and moved so as to simultaneously tear along the line 130 and along the line 86, thereby simultaneously separating the leaves 82 and 92 from one another and separating the extension 84 from the leaf 80 to open the package. To facilitate the proper insertion of the tool 88 between the two leaves 82 and 92 the package 148, as shown best in FIG. 11, preferably has a quarter-round cutout 150 in the extension 84 and a similar registering quarter-round cutout 150 in the leaf 82 adjacent one corner of the package so that a portion of the folded edge 130 is made visible.

Turning to FIG. 15, the illustrated process is similar to that shown in FIG. 9 except that prior to arriving at Stage A the web 118 is cut to define a series of quarter-round cutouts 150, 150 in the strip 140 and to define a similar series of quarter-round cutouts 150, 150 in the strip 138. The process of FIG. 15 further differs from the process of FIG. 9 in that at Stage C the fold line 130 is left intact rather than being severed from the web as shown at 142 in FIG. 9.

I claim:

1. Method of continuously forming sealed mailing packages, each package consisting of a brochure having a plurality of pages and an unsealed envelope having a seal flap, pocket and mouth, said pocket being within said mailing package, said pages and said seal flap being adhesively bound at a first edge of said package, a second, sealed, edge of said package opposite said first edge being sealed by a second flap, said flap extending from an outside page (140) of said brochure, comprising:

a. Advancing a web of sheet material;

b. Applying remoistenable adhesive to an area of the web, said area corresponding to the seal flaps of the envelope portion of the mailing package; and drying said remoistenable adhesive;

c. Dividing the web longitudinally into a plurality of three or more strips by scoring a plurality of spaced apart fold lines;

d. Applying wet adhesive to a first outside strip, said adhesive being transverse lines and defining the sides of each of the envelope pockets;

e. Applying spots of wet adhesive at an area corresponding to the adhesively bound first edge of each of the mailing packages;

f. Perforating the web longitudinally adjacent the area of remoistenable adhesive;

g. Removing from the web cutouts at areas corresponding to at least one area located at the second sealed edge of each of said sealed mailing packages;

Applying spots of wet adhesive at areas corresponding to the second flap of each of the sealed mailing packages said second flap being a second outside strip at the edge of the web opposite said first outside strip;

i. Forming a strip of envelope pockets by folding the web until the first outside strip with the transverse gum lines and the adjacent strip are in adhesive contact, the bottom of said pockets being at one margin of the web;

j. Forming envelope packages by folding said web until the bottom of the pockets is adjacent said second outside flap;

k. Sealing said packages by folding said second outside strip into adhesive contact with the package;

l. Cutting said sealed package transversely along imaginary cut lines to provide a plurality of individual packages, said cut lines being coincidental with the sides of said envelope pockets.

2. The method as described in claim 1 wherein the web folding operations involve an initial upward movement of the web.

3. Method of continuously forming sealed mailing packages, each package consisting of a brochure having a plurality of pages and an unsealed envelope having a seal flap, pocket and mouth, said pocket being within said mailing package, said pages and said seal flap being adhesively bound at a first edge of said package, a second sealed edge of said package opposite said first edge being sealed by a second flap, said flap extending from an outside page (140) of said brochure comprising:

a. Advancing a web of sheet material;

b. Scoring the web into four sections said sections being a second inner strip and a third inner strip and a first edge section and second edge section, said second and said third inner strips being of substantially equal width, said first edge section being less than 1.5 times the width of said inner sections and said second opposite edge section being greater than 1.2 but less than 2 times the width of said inner sections;

c. Perforating said first edge section to form two strips, a first outside strip and a first inner strip, said first inner strip having essentially the same width as said second and said third inner strips;

d. Scoring said second edge section to form two strips, a second outside strip and a fourth inner strip, said fourth inner strip being essentially the same width as said first, said second, and said third inner strips;

e. Removing from the web cutouts at areas corresponding to at least one area located at the second, sealed, edge of each of said sealed mailing packages;

f. Applying remoistenable adhesive to an area of the web, said area corresponding to the seal flaps of the envelope portion of the mailing package, and drying said remoistenable adhesive;

g. Applying wet adhesive to the second outside strip, said adhesive being in transverse lines and defining the sides of each of the envelope pockets;

h. Applying spots of wet adhesive at an area corresponding to the adhesively bound first edge of each of the mailing packages;

i. Perforating the web longitudinally adjacent the area of remoistenable adhesive;

j. Applying spots of wet adhesive at areas corresponding to the second flap of the sealed mailing package, said second flap being said first outside strip at the edge of the web opposite said second outside strip;

k. Forming a strip of envelope pockets by folding said second outside strip and the adjacent fourth inner strip into adhesive contact, the bottom of said pockets being at one margin of the web;

l. Folding the web to superimpose the strip of envelope pockets upon the first inner strip to form a first superimposed area and to superimpose said second inner strip upon said third inner strip to form a second superimposed area;

m. Forming envelope packages by folding said web to superimpose said first superimposed area and said second superimposed area;

n. Sealing said packages by folding said first outside strip into adhesive contact with the package;

o. Cutting said sealed package transversely along imaginary cut lines to provide a plurality of individual packages, said cut lines being coincidental with the sides of said envelope pockets.

4. The method as described in claim 3 wherein the web folding operations involve an initial upward movement of the web.

5. The method as described in claim 3 wherein the web is perforated at the score separating said second inner strip and said third inner strip prior to the web folding operations.

* * * * *